US007856805B2

(12) United States Patent
Hostettler et al.

(10) Patent No.: US 7,856,805 B2
(45) Date of Patent: Dec. 28, 2010

(54) NON-EXTENDING HINGED BRACELET

(75) Inventors: Sébastien Hostettler, Sonceboz (CH); Philippe Loetscher, Evilard (CH)

(73) Assignee: The Swatch Group Management Services AG, Biel (CH)

( * ) Notice: Subject to any disclaimer, the term of this patent is extended or adjusted under 35 U.S.C. 154(b) by 647 days.

(21) Appl. No.: 11/422,160

(22) Filed: Jun. 5, 2006

(65) Prior Publication Data

US 2006/0272354 A1 Dec. 7, 2006

(30) Foreign Application Priority Data

Jun. 6, 2005 (EP) ..... 05012126

(51) Int. Cl.

| | |
|---|---|
| ***F16G 13/00*** | (2006.01) |
| ***A44C 5/00*** | (2006.01) |
| ***A44C 5/02*** | (2006.01) |
| ***A44C 25/00*** | (2006.01) |

(52) U.S. Cl. ..... 59/78; 63/3; 63/4; 63/38; 59/82

(58) Field of Classification Search ..... 59/78, 59/79.1, 80, 82, 84, 85, 91, 93; 63/3, 3.1, 63/4, 33, 37, 38

See application file for complete search history.

(56) References Cited

U.S. PATENT DOCUMENTS

| | | | | |
|---|---|---|---|---|
| 3,680,304 | A * | 8/1972 | Heckel | 63/4 |
| 4,930,304 | A * | 6/1990 | Meister | 63/4 |
| 5,154,047 | A * | 10/1992 | Takagi | 63/3 |
| 5,365,753 | A * | 11/1994 | Carrola | 63/4 |
| 6,418,706 | B1 | 7/2002 | Kit | |

FOREIGN PATENT DOCUMENTS

| | | |
|---|---|---|
| CH | 663 136 | 11/1987 |
| CH | 664 676 A5 | 3/1988 |
| DE | 21 33 008 | 1/1973 |
| EP | 0 586 981 A1 | 3/1994 |
| EP | 0 738 480 A1 | 10/1996 |

OTHER PUBLICATIONS

European Search Report issued in corresponding application No. EP 05 01 2126 completed Dec. 13, 2005.

Australian Search Report issued in corresponding application in Singapore No. SG 200603308-8, completed Jul. 18, 2006 and mailed Jul. 21, 2006.

* cited by examiner

*Primary Examiner*—Robert J. Sandy
*Assistant Examiner*—David Reese
(74) *Attorney, Agent, or Firm*—Griffin & Szipl, P.C.

(57) ABSTRACT

The invention concerns a non-extending hinged bracelet including a plurality of links (6, 6') hinged one after the other, each of the links including on one side a male hinge element and on the other side a female hinge element, the male hinge element of one link (6) being inserted in the female hinge element of the next link (6') to form a hinge (1), said hinge elements being traversed by a pin forming the articulation of the hinge (1), a U-shaped part (14) which covers said hinge (1) including branches (16) which are engaged on either side of the hinge (1) and which have holes (18) in which the ends of the pin are engaged, said bracelet being characterized in that a cover (12) extending between two adjacent links (6, 6') is arranged between the hinge (1) and the U-shaped part (14).

26 Claims, 2 Drawing Sheets

NON-EXTENDING HINGED BRACELET

This application claims priority from European Patent Application 05012126.8 filed Jun. 6, 2005, the entire disclosure of which is incorporated herein by reference.

FIELD OF THE INVENTION

The present invention concerns a hinged, non-extending bracelet or wristband. This bracelet may be a piece of jewellery or be used for wearing a watch on the wrist.

BACKGROUND OF THE INVENTION

A hinged non-extending bracelet is known from CH Patent No. 663 136. This bracelet includes a succession of elements hinged together by means of hinges. Each element includes on one side a median knuckle, and on the opposite side two end knuckles between which the median knuckle of the neighbouring element is inserted. The assembly between the links is provided by pushpins that pass freely through the knuckles of the adjacent links. These pushpins are held in place by U-shaped parts whose branches engage on either side of the end knuckles and have holes in which the pilot points of the pushpins engage. In addition to a functional role consisting in holding the pushpins in place, the U-shaped parts have a decorative role, in that, as their appearance is different to that of the hinged elements, they mark the separation between these elements.

When the bracelet is laid out flat, the U-shaped parts conceal the knuckles. Conversely, when the bracelet is bent to fit the shape of the wrist, the knuckles are visible, which is detrimental to the aesthetic appearance of the bracelet, particularly when the knuckles are made of different material from the U-shaped parts, for example in the case of two-colour bracelets.

It is an object of the present invention to overcome the aforementioned problem in addition to others, by providing a non-extending hinged bracelet whose aesthetic appearance is improved, particularly when the knuckles are made of different material from the U-shaped parts arranged between two successive links.

SUMMARY OF THE INVENTION

The present invention therefore concerns a non-extending hinged bracelet including a plurality of links hinged one after the other, each of the links including on one side a male hinge element and on the other side a female hinge element, the male hinge element of one link being inserted into the female hinge element of the next link to form a hinge, said hinge elements being traversed by a pin forming the articulation of the hinge, a U-shaped part which covers said hinge including branches which engage on either side of the hinge and which have holes in which the ends of the pin engage, said bracelet being characterized in that a cover extending between two adjacent links is arranged between the hinge and the U-shaped part.

Owing to these features, the present invention provides a non-extending bracelet with hinged links including a cover that masks the hinges both when the bracelet is flat and in a curved position, thus substantially improving the aesthetic appearance of the bracelet, particularly when the hinges are made of different material from the U-shaped parts.

According to a complementary feature of the invention, the cover is a resilient strip whose transverse edges are engaged in respective housings provided in the two adjacent links.

The resilient nature of the strip thus enables a certain return force to be exerted on the links in the flat position of the bracelet.

According to yet another feature of the invention, the strip has an aperture for cooperating with a lug provided on the lower surface of the U-shaped part in order to hold it in place.

According to a particular embodiment of the invention, each of the links includes, on one side, a median knuckle and on the opposite side, two end knuckles, the median knuckle being inserted between the two end knuckles of the neighbouring link, said knuckles being traversed by the hinge pin and the branches of the U-shaped part engaging on either side of the end knuckles.

According to a first variant, the hinge pin is a pushpin which has pilot points at both of its ends for engaging in the branches of the U-shaped part.

According to a second variant, a cylindrical tube of the same length as the median knuckle is introduced into the latter, said tube having a reduced diameter locally, and the pin having at a corresponding place on its length a groove for cooperating with the reduced diameter of the tube in order to immobilise the tube axially.

BRIEF DESCRIPTION OF THE DRAWINGS

Other features and advantages of the present invention will appear more clearly from the following detailed description of an embodiment of the bracelet according to the invention, this example being given purely by way of non-limiting illustration in conjunction with the annexed drawing, in which.

DETAILED DESCRIPTION OF THE INVENTION

The present invention proceeds from the general inventive idea which consists in providing a cover between two adjacent links of a non-extending hinged bracelet to conceal the hinge that links said two links. Consequently, the hinges connecting the links to each other remain invisible to the observer whether the bracelet is flat or curved, which substantially improves its aesthetic appearance, particularly when the hinge is made of different material to the U-shaped parts as in the case of two-coloured bracelets.

Figure 1:
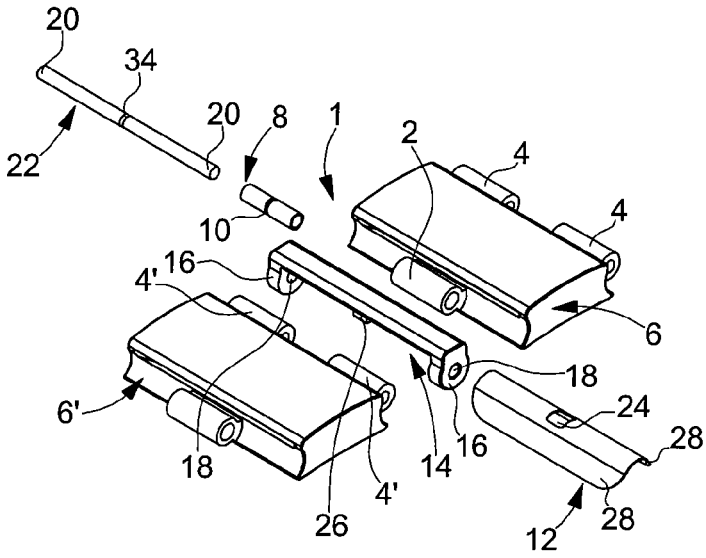
FIG. 1 is an exploded perspective view of a hinge connecting two adjacent links of a bracelet according to the invention.

FIG. 1 is an exploded perspective view of a hinge connecting two adjacent links of a bracelet according to the invention. Designated as a whole by the general reference numeral 1, this hinge includes a median knuckle 2 and two end knuckles 4 provided on the opposite sides of a bracelet link 6. These knuckles 2 and 4 are arranged such that the median knuckle 2 of a link 6 is inserted between the two end knuckles 4' of the adjacent link 6'. The knuckles are formed of tubes which can be welded onto the links. According to a variant, they can also be integral with said links. It goes without saying that this example hinge is given purely by way of illustration and that other types of hinges including a male hinge element that is inserted into a female hinge element can be envisaged.

A tube 8 whose external diameter corresponds to the diameter of the hole in the median knuckle is introduced into the latter. It is immobilised axially because the diameter of the holes in the end knuckles is slightly smaller than the diameter of the hole in the median knuckle. Tube 8 has locally, preferably in its middle or at each of its ends, a reduced diameter or neck 10. Once the knuckles are aligned, a cover 12 is placed under a U-shaped part 14 whose branches 16 engage on either side of end knuckles 4. Branches 16 of U-shaped part 14 are pierced with holes 18 in which the ends 20 of a pin 22, described hereinafter, are engaged.

Cover 12 which extends between two adjacent links is arranged underneath U-shaped part 14, between the knuckles and said U-shaped part. The function of this cover is to conceal the hinges formed by the knuckles and the pins both when the bracelet is in the flat and in the curved position, substantially improving the aesthetic appearance of the bracelet, particularly when the knuckles are made of a different material to the U-shaped parts.

To enable it to be immobilised, cover 12 has an aperture 24 for cooperating with a lug 26, provided on the bottom surface of U-shaped part 14.

Figure 2:
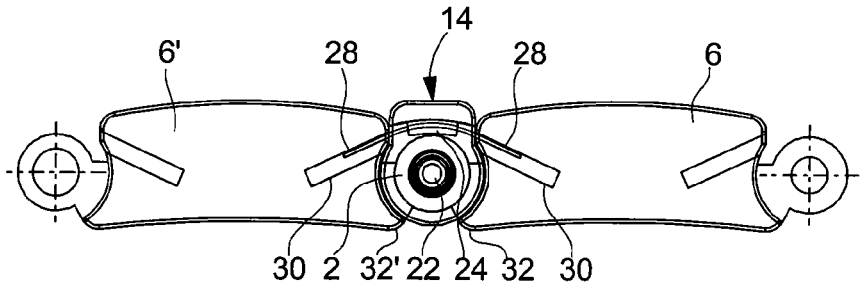
FIG. 2 is a cross-section of two adjacent links connected by a hinge in the flat position.
Figure 3:
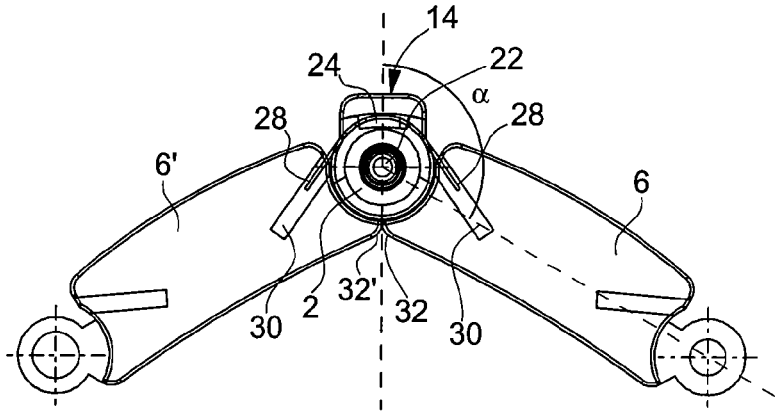
FIG. 3 is a similar view to that of FIG. 2, the links being in the curved position.
Figure 4:
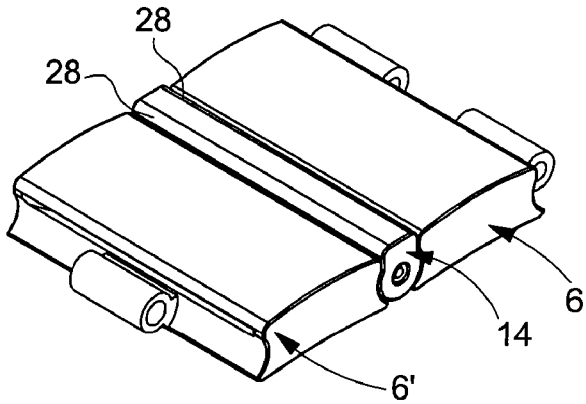
FIG. 4 is a perspective view of two adjacent links in the flat position.
Figure 5:
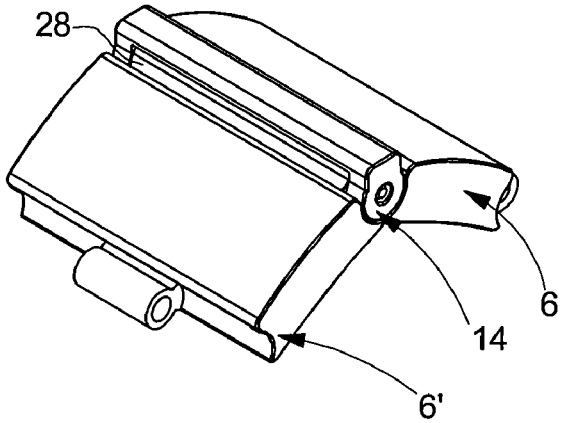
FIG. 5 is a similar view to that of FIG. 4, the links being in the curved position.

Advantageously, cover 12 is a resilient strip whose transverse edges 28 engage in respective housings 30 arranged in the thickness of two adjacent links. When the bracelet is flat (see FIGS. 2 and 4), the transverse edges 28 of the strip are not deformed. However, when the bracelet is curved to fit its user's wrist (see FIGS. 3 and 5), the transverse edges 28 of the strip bend and deform resiliently, consequently exerting on the links a return force to the flat position of the bracelet.

According to a particular embodiment of the invention, along their opposite bottom edges the links have an abutment surface 32 by which they abut against the opposite abutment surface 32' of the adjacent link, which limits their clearance to an inclination of the order of $\alpha=30°$, for example, in relation to the flat position of the bracelet and prevents the resilient strip from leaving its housings. It could also be envisaged that the links have even greater clearance. In such case, the strip could be locked by any appropriate means such as for example by screws.

Figure 7:
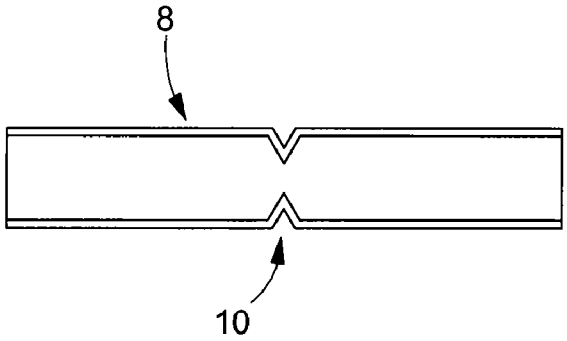
FIG. 7 is a cross-section of a tube for axially immobilising a pin.

Once the transverse edges 28 of the resilient strip are engaged in the respective housing of the aligned links and knuckles, branches 16 of U-shaped part 14 are engaged on either side of the end knuckles and pin 22 is inserted into holes 18 pierced in branches 16 of U-shaped part 14 and into the end and median knuckles in order to join two adjacent links. At one point on its length, in this case at its middle, pin 22 has a groove 34 for cooperating with neck 10 provided in the middle of tube 8 in order to immobilise said pin 22 axially. In fact, on the inner surface of tube 8 neck 10 forms a raised portion which will engage in groove 34 provided on the external surface of pin 22 (see FIG. 7).

Figure 6:
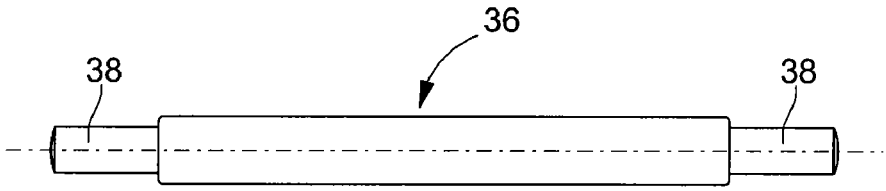
FIG. 6 is a view of a pushpin.

It goes without saying that the present invention is not limited to the embodiment that has just been described and that various simple alterations and variants could be envisaged by those skilled in the art without departing from the scope of the present invention as defined by the annexed claims. In particular, the hinge pin can be a pushpin 36 like that shown in FIG. 6, whose external diameter corresponds to the internal diameter of the holes in the knuckles and which passes freely through the latter, pilot points 38 of the pin engaging in the holes 18 pierced in branches 16 of U-shaped part 14. According to yet another variant, the hinge pin could be a split pin, a knurled pin or any other known connecting means.

What is claimed is:

1. A non-extending hinged bracelet including:

a plurality of links hinged one after the other, each of the links including on one side a male hinge element and on the other side a female hinge element, wherein the male hinge element of one link is inserted in the female hinge element of the next link to form a hinge, wherein the hinge elements are traversed by a pin forming an articulation of the hinge, and a U-shaped part covers the hinge including branches that are engaged on either side of the hinge and that have holes in which ends of the pin are engaged, wherein the hinged bracelet further comprises a cover extending between two adjacent links and that is arranged between the hinge and the U-shaped part, wherein the cover covers both a top surface of the male hinge element and a top surface of the female hinge element of the two adjacent links to conceal the hinge formed by the male and female hinge elements when the bracelet is in a flat position and in a curved position, wherein the top surface of the male hinge element and the top surface of the female hinge element are defined as surfaces extending in an upper plane opposite to a lower plane of the bracelet when the bracelet is in the flat position, and wherein the lower plane is disposed on a side of the bracelet adapted to fit a user's wrist.

2. The bracelet according to claim 1, wherein each link includes on one side a median knuckle and on the opposite side two end knuckles, the median knuckle of one link being inserted between the two end knuckles of the next link.

3. The bracelet according to claim 1, wherein the links have, along lower edges, an abutment surface via which the links abut against an opposite abutment surface of the adjacent link to limit clearance freedom of said links.

4. A non-extending hinged bracelet including:

a plurality of links hinged one after the other, each of the links including on one side a male hinge element and on the other side a female hinge element, wherein the male hinge element of one link is inserted in the female hinge element of the next link to form a hinge, wherein the hinge elements are traversed by a pin forming an articulation of the hinge, and a U-shaped part covers the hinge including branches that are engaged on either side of the hinge and that have holes in which ends of the pin are engaged, wherein the hinged bracelet further comprises a cover extending between two adjacent links and that is arranged between the hinge and the U-shaped part, and wherein the cover is a resilient strip whose transverse edges engage in respective housings provided in the two adjacent links.

5. The bracelet according to claim 4, wherein the cover has an aperture for cooperating with a lug provided on a bottom surface of the U-shaped part in order to hold the cover in place.

6. The bracelet according to claim 5, wherein each link includes on one side a median knuckle and on the opposite side two end knuckles, the median knuckle of one link being inserted between the two end knuckles of the next link.

7. The bracelet according to claim 6, wherein a cylindrical tube of the same length as the median knuckle is introduced therein, said tube having locally a reduced diameter, and wherein the hinge pin is a pin having, at a corresponding place on the length thereof, a groove for cooperating with the reduced diameter of the tube to immobilise said tube axially.

8. The bracelet according to claim 6, wherein the hinge pin is a pushpin that has at both ends pilot points engaged in the branches of the U-shaped part.

9. The bracelet according to claim 5, wherein a cylindrical tube of the same length as the median knuckle is introduced therein, said tube having locally a reduced diameter, and wherein the hinge pin is a pin having, at a corresponding place on the length thereof, a groove for cooperating with the reduced diameter of the tube to immobilise said tube axially.

10. The bracelet according to claim 5, wherein the hinge pin is a pushpin that has at both ends pilot points engaged in the branches of the U-shaped part.

11. The bracelet according to claim 4, wherein each link includes on one side a median knuckle and on the opposite side two end knuckles, the median knuckle of one link being inserted between the two end knuckles of the next link.

12. The bracelet according to claim 11, wherein a cylindrical tube of the same length as the median knuckle is introduced therein, said tube having locally a reduced diameter, and wherein the hinge pin is a pin having, at a corresponding place on the length thereof, a groove for cooperating with the reduced diameter of the tube to immobilise said tube axially.

13. The bracelet according to claim 11, wherein the hinge pin is a pushpin that has at both ends pilot points engaged in the branches of the U-shaped part.

14. The bracelet according to claim 4, wherein the hinge pin is a pushpin that has at both ends pilot points engaged in the branches of the U-shaped part.

15. A non-extending hinged bracelet including:

a plurality of links hinged one after the other, each of the links including on one side a male hinge element and on the other side a female hinge element, wherein the male hinge element of one link is inserted in the female hinge element of the next link to form a hinge, wherein the hinge elements are traversed by a pin forming an articulation of the hinge, and a U-shaped part covers the hinge including branches that are engaged on either side of the hinge and that have holes in which ends of the pin are engaged, wherein the hinged bracelet further comprises a cover extending between two adjacent links and that is arranged between the hinge and the U-shaped part, and wherein the cover has an aperture for cooperating with a lug provided on a bottom surface of the U-shaped part in order to hold the cover in place.

16. The bracelet according to claim 15, wherein each link includes on one side a median knuckle and on the opposite side two end knuckles, the median knuckle of one link being inserted between the two end knuckles of the next link.

17. The bracelet according to claim 16, wherein a cylindrical tube of the same length as the median knuckle is introduced therein, said tube having locally a reduced diameter, and wherein the hinge pin is a pin having, at a corresponding place on the length thereof, a groove for cooperating with the reduced diameter of the tube to immobilise said tube axially.

18. The bracelet according to claim 16, wherein the hinge pin is a pushpin that has at both ends pilot points engaged in the branches of the U-shaped part.

19. The bracelet according to claim 15, wherein the hinge pin is a pushpin that has at both ends pilot points engaged in the branches of the U-shaped part.

20. A non-extending hinged bracelet including:

a plurality of links hinged one after the other, each of the links including on one side a male hinge element and on the other side a female hinge element, wherein the male hinge element of one link is inserted in the female hinge element of the next link to form a hinge, wherein the hinge elements are traversed by a pin forming an articulation of the hinge, and a U-shaped part covers the hinge including branches that are engaged on either side of the hinge and that have holes in which ends of the pin are engaged, wherein the hinged bracelet further comprises a cover extending between two adjacent links and that is arranged between the hinge and the U-shaped part, wherein the cover covers both the male hinge element and the female hinge element of the two adjacent links, wherein the cover is a resilient strip whose transverse edges engage in respective housings provided in the two adjacent links.

21. A non-extending hinged bracelet including:

a plurality of links hinged one after the other, each of the links including on one side a male hinge element and on the other side a female hinge element, wherein the male hinge element of one link is inserted in the female hinge element of the next link to form a hinge, wherein the hinge elements are traversed by a pin forming an articulation of the hinge, and a U-shaped part covers the hinge including branches that are engaged on either side of the hinge and that have holes in which ends of the pin are engaged, wherein the hinged bracelet further comprises a cover extending between two adjacent links and that is arranged between the hinge and the U-shaped part, wherein the cover covers both the male hinge element and the female hinge element of the two adjacent links, wherein the cover has an aperture for cooperating with a lug provided on a bottom surface of the U-shaped part in order to hold the cover in place.

22. A non-extending hinged bracelet including:

a plurality of links hinged one after the other, each of the links including on one side a male hinge element and on the other side a female hinge element, wherein the male hinge element of one link is inserted in the female hinge element of the next link to form a hinge, wherein the hinge elements are traversed by a pin forming an articulation of the hinge, and a U-shaped part covers the hinge including branches that are engaged on either side of the hinge and that have holes in which ends of the pin are engaged, wherein the hinged bracelet further comprises a cover extending between two adjacent links and that is arranged between the hinge and the U-shaped part, wherein the cover covers both the male hinge element and the female hinge element of the two adjacent links, wherein each link includes on one side a median knuckle and on the opposite side two end knuckles, the median knuckle of one link being inserted between the two end knuckles of the next link, wherein a cylindrical tube of the same length as the median knuckle is introduced therein, said tube having locally a reduced diameter, and wherein the hinge pin is a pin having, at a corresponding place on the length thereof, a groove for cooperating with the reduced diameter of the tube to immobilise said tube axially.

23. A non-extending hinged bracelet including:

a plurality of links hinged one after the other, each of the links including on one side a male hinge element and on the other side a female hinge element, wherein the male hinge element of one link is inserted in the female hinge element of the next link to form a hinge, wherein the hinge elements are traversed by a pin forming an articulation of the hinge, and a U-shaped part covers the hinge including branches that are engaged on either side of the hinge and that have holes in which ends of the pin are engaged, wherein the hinged bracelet further comprises a cover extending between two adjacent links and that is arranged between the hinge and the U-shaped part, wherein the cover covers both the male hinge element and the female hinge element of the two adjacent links, wherein the hinge pin is a pushpin that has at both ends pilot points engaged in the branches of the U-shaped part.

24. A non-extending hinged bracelet including:

a plurality of links hinged one after the other, each of the links including on one side a male hinge element and on the other side a female hinge element, wherein the male hinge element of one link is inserted in the female hinge element of the next link to form a hinge, wherein the hinge elements are traversed by a pin forming an articulation of the hinge, and a U-shaped part covers the hinge including branches that are engaged on either side of the hinge and that have holes in which ends of the pin are engaged, wherein the hinged bracelet further comprises a cover extending between two adjacent links and that is arranged between the hinge and the U-shaped part, wherein the cover covers both the male hinge element and the female hinge element of the two adjacent links, wherein each link includes on one side a median knuckle and on the opposite side two end knuckles, the median knuckle of one link being inserted between the two end knuckles of the next link, wherein the hinge pin is a pushpin that has at both ends pilot points engaged in the branches of the U-shaped part.

25. A non-extending hinged bracelet including:

a plurality of links hinged one after the other, each of the links including on one side a male hinge element and on the other side a female hinge element, wherein the male hinge element of one link is inserted in the female hinge element of the next link to form a hinge, wherein the hinge elements are traversed by a pin forming an articulation of the hinge, and a U-shaped part covers the hinge including branches that are engaged on either side of the hinge and that have holes in which ends of the pin are engaged, wherein the hinged bracelet further comprises a cover extending between two adjacent links and that is arranged between the hinge and the U-shaped part, wherein the cover covers both the male hinge element and the female hinge element of the two adjacent links on the top thereof to conceal the hinge formed by the male and female hinge elements when the bracelet is in a flat position and in a curved position, and wherein each link includes on one side a median knuckle and on the opposite side two end knuckles, wherein the median knuckle of one link is inserted between the two end knuckles of the next link.

26. A non-extending hinged bracelet including:

a plurality of links hinged one after the other, each of the links including on one side a male hinge element and on the other side a female hinge element, wherein the male hinge element of one link is inserted in the female hinge element of the next link to form a hinge, wherein the hinge elements are traversed by a pin forming an articulation of the hinge, and a U-shaped part covers the hinge including branches that are engaged on either side of the hinge and that have holes in which ends of the pin are engaged, wherein the hinged bracelet further comprises a cover extending between two adjacent links and that is arranged between the hinge and the U-shaped part, wherein the cover covers both the male hinge element and the female hinge element of the two adjacent links on the top thereof to conceal the hinge formed by the male and female hinge elements when the bracelet is in a flat position and in a curved position, wherein the links have, along lower edges, an abutment surface via which the links abut against an opposite abutment surface of the adjacent link to limit clearance freedom of the links.

* * * * *